United States Patent [19]

Hertell et al.

[11] 4,355,655

[45] Oct. 26, 1982

[54] HYDRAULIC CONTROL APPARATUS FOR LOAD INDEPENDENT FLOW REGULATION

[75] Inventors: Siegfried Hertell, Radevormwald; Claus Kirchherr, Remscheid; Horst Kahl, Wermelskirchen; Siegfried Hoffmann, Leichlingen, all of Fed. Rep. of Germany

[73] Assignee: Barmag Barmer Maschinenfabrik, Remscheid, Fed. Rep. of Germany

[21] Appl. No.: 304,716

[22] Filed: Sep. 23, 1981

Related U.S. Application Data

[62] Division of Ser. No. 125,096, Feb. 27, 1980, Pat. No. 4,303,091.

[30] Foreign Application Priority Data

Mar. 1, 1979 [DE] Fed. Rep. of Germany ..... 2908018

[51] Int. Cl.[3] ..... F15B 13/04

[52] U.S. Cl. ..... 137/117; 91/451; 137/596.13

[58] Field of Search ..... 91/451; 137/117, 596.13

[56] References Cited

U.S. PATENT DOCUMENTS

| | | | |
|---|---|---|---|
| 3,631,890 | 1/1972 | McMillen | 137/596.13 |
| 3,777,773 | 12/1973 | Tolbert | 137/596.13 X |
| 3,828,813 | 8/1974 | Haussler | 137/596.13 |
| 3,937,129 | 2/1976 | Miller | 137/596.13 X |

*Primary Examiner*—Gerald A. Michalsky

*Attorney, Agent, or Firm*—Bell, Seltzer, Park & Gibson

[57] ABSTRACT

A hydraulic flow control apparatus is provided which is adapted to provide a constant pressure differential between a pump and an external load. The apparatus includes a housing, and a balance piston slideably mounted therein. The pump pressure acts to bias the piston in a direction toward a pump bypass position, and the piston is urged in the other direction and toward its operating position by the consumer pressure and a spring. Means are also provided whereby the pressure of the pump necessary to move the piston toward its bypass position and against the force of the spring, may be minimized during operation in the idling mode, to thereby minimize power consumption.

2 Claims, 2 Drawing Figures

HYDRAULIC CONTROL APPARATUS FOR LOAD INDEPENDENT FLOW REGULATION

Figure 1:
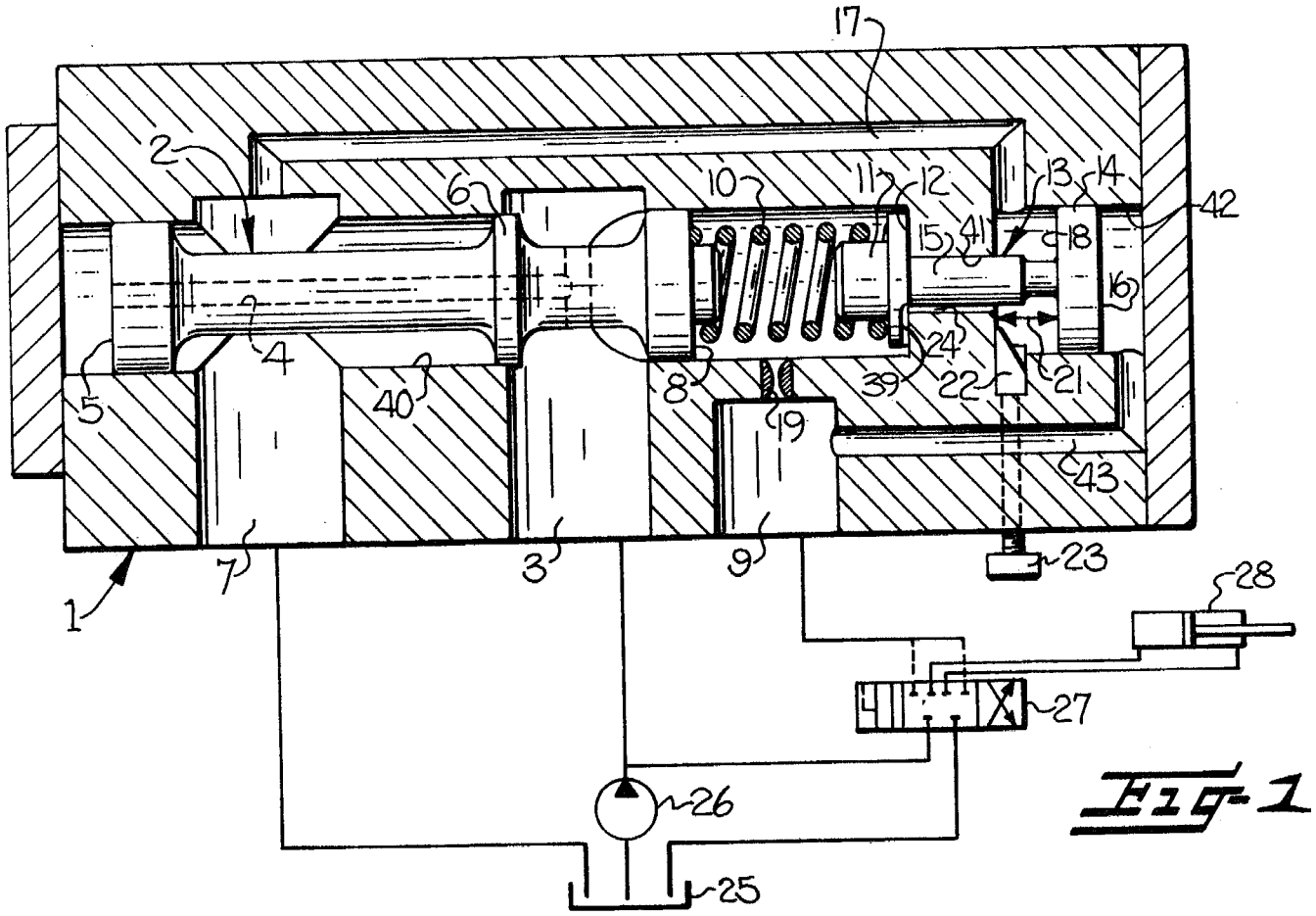

This is a divisional of application Ser. No. 125,096 filed Feb. 27, 1980, now U.S. Pat. No. 4,303,091.

The present invention relates to an improved flow control apparatus adapted to provide load independent flow regulation in a hydraulic power system or the like, and which is characterized by the ability to minimize the idling power consumption of the pump when the load is removed from the system.

U.S. Pat. No. 3,828,813 to Haussler discloses a flow control apparatus for load-independent flow control, whereby a so-called "pressure-difference balance" serves to maintain a constant but adjustable pressure difference between a pump pressure line and a given connected consumer load. The pressure difference balance consists of a piston that can move in a cylindrical bore, which is connected on one side with the pump pressure line. In this regard, it should be noted that a direct connection to the pump is not required, and that the pump pressure may be first increased or decreased by suitable hydraulic means if this appears to be expedient to achieve better function of the pressure-difference balance. The only thing that is important is that the one piston side receives a pressure that follows the pump pressure in accordance with a defined function.

The other piston side of the Haussler apparatus is connected with the load pressure, that is, the pressure prevailing in the consumer line. The piston is additionally biased by a spring on this so-called "load pressure side" against the pressure on the pump pressure side. The resulting effect is that the piston is in an equilibrium condition, which is determined, on the one hand by the pump pressure and, on the other hand, by the total of the spring tension and the load pressure. The balance cylinder is connected by an opening to the sump, being opened and closed by a control edge of the balance piston. Opening and closing actions should preferably be steady. As noted above with respect to the pump pressure, the consumer pressure on the load pressure side also does not have to be direct. It is sufficient here as well that a pressure is exerted which follows the load pressure in accordance with a certain known function.

The Haussler apparatus, which is termed a "pressure difference balance" has the purpose of maintaining a certain constant pressure difference between the pump line and the consumer line. The effect is that the flow from the pump to the consumer load, which depends in particular on the pressure difference, is kept constant. This gives the capability of operating the consumer load independently of its given load with a predetermined constant speed. The so-called "pressure difference balance" further serves the purpose, on closure of the consumer line, of providing for a "pressureless" oil circulation, that is, oil circulation against a slight residual pressure of a pump with a constant delivery. This "pressureless" circulation comes about, when the consumer load is removed, by having the load pressure side of the pressure difference balance connected with the sump through a special switching device. The pressure on the load pressure side of the pressure difference balance thereby falls to zero, so that the balance piston assumes an equilibrium position, which is determined simply by the pump pressure and the spring pressure on the other side. This means that the oil delivered by the pump is pumped through the pressure difference balance and only has to overcome the spring tension.

For control technology reasons, a relatively strong spring is used for the piston of the pressure difference balance. It follows that in the no-load or idling mode, the pump must deliver sufficient pressure to act against a relatively high spring force, which in turn requires a relatively large power consumption.

In accordance with the present invention, the above disadvantage is overcome, so as to permit minimal consumption of power by the pump during idling, as well as provide for readily adapting the residual or idling pressure to the given requirements of the particular end use.

In one embodiment of the present invention, there is provided a differential piston mounted adjacent the end of the bore connected to the consumer line, and such that the pressure in the consumer line moves the differential piston toward the spring to amplify the force of the spring acting against the balance piston. The amplifying force is removed when the pressure in the consumer line is removed, to thereby minimize the pump pressure which is required to move the piston to its bypass position. Further, parallel separate passageways are provided from the consumer line to the operative end of each of the balance piston and differential piston, and restriction means may be provided in the passageway leading to the end of the balance piston which results in the differential piston rapidly moving the balance piston toward its operative or non-bypass position and thereby assuring a prompt response to pressure in the consumer line.

The first embodiment also incorporates means for providing a controlled leakage, which is insignificant to the pump delivery and the hydraulic system, which acts to dissipate the pressure on the load pressure side of the piston when the consumer load is switched off, such that when the consumer load is switched off, the oil from the load pressure side of the pressure difference balance escapes as leakage and flows to the sump.

The first embodiment also has provision for adjusting the reciprocating travel of the differential piston. The spring tension of the spring acting on the pressure difference balance can thereby be adjusted in operation and/or in the idling mode as required by the control action of the connected consumer load, or as is desirable to achieve idling mode power consumption that is as low as possible.

In a second embodiment of the present invention, means are provided to increase the force exerted on the balance piston by the pump pressure in the idling mode, thus compensating for the spring tension acting on the piston to a far greater extent than in the operating mode. More particularly, the pump pressure or a corresponding pressure is applied in the idling mode to a retaining piston, which is in contact with one end of the pressure balance piston. When a consumer load is switched in, the retaining piston is moved back to a position spaced from the balance piston. If the retaining cylinder in which the retaining piston moves is hydraulically separated from the balance cylinder, any pressure in the system can be used for this purpose. Preferably, however, the balance cylinder and the retaining cylinder merge. In this case, the rearward moving of the retaining piston on switching in of the consumer load is carried out by the pressure generated on the pump pressure side of the balance piston.

Figure 2:
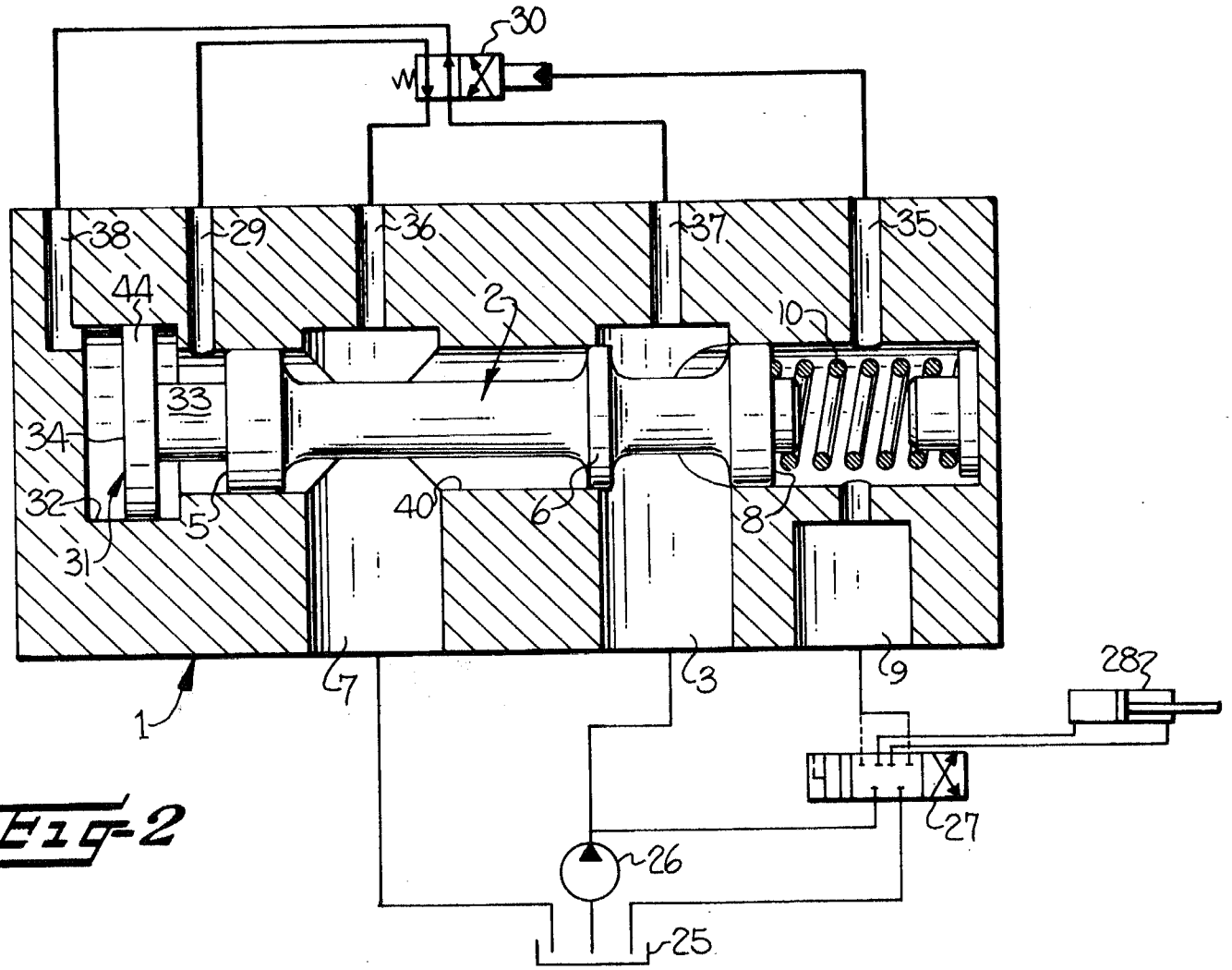

Some of the objects and advantages of the invention having been stated, others will appear as the description proceeds, when taken in connection with the accompanying drawings, in which FIG. 1 is a schematic representation of a flow control apparatus embodying the features of the present invention; and FIG. 2 is a schematic representation of a second embodiment of the invention.

Referring more particularly to the embodiment illustrated in FIG. 1, there is disclosed a balance piston 2 adapted to move in a cylindrical bore 40 in the housing 1. The housing has the pump pressure inlet channel 3, which is connected with the delivery side of a constant delivery pump 26. The pump pressure is transmitted from the channel 3 through the overflow channel 4 in the piston to the pump pressure side 5 of the balance piston 2 and which defines a first end portion of the bore 40. The piston 2 is thus forced to the right as shown in the drawing by the pump pressure.

The housing 1 further has a consumer channel 9, which is connectable with the hydraulic consumer load 28 and serves to transmit the consumer pressure through throttle 19 to the load pressure side 8 of the balance piston 2. The load pressure side 8 defines a second end portion of the bore, and a spring 10 is disposed in such second end portion to bias the piston 2 toward the left. An equilibrium state thus exists at the balance piston, governed by the pump pressure on the pump pressure side 5 and the load pressure as well as the spring tension on the load pressure side 8. If the pump pressure preponderates, the balance piston 2 will be displaced to the right, and the control edge 6 thereby releases flow to the sump outlet channel 7 and to the sump 25, which is essentially pressureless. The pump pressure in the pump pressure channel 3 as well as the pressure of the delivery to the load are thereby reduced until eqiulibrium is established again between the pump pressure side 5 and the load pressure side 8 of the balance piston 2. The resulting effect is the creation of a constant pressure difference between the pump pressure and the load pressure, note the above Haussler patent for further details.

It is to be noted that the constant pressure difference between the pump pressure and the load pressure can also be achieved by an arrangement wherein these pressures are not applied directly to the pump pressure side 5 and to the load pressure side 8, respectively, but rather after a suitable increase or decrease. The only thing essential is that the pressure applied to the balance piston has a defined relationship to the corresponding pump or load pressures.

If the connection between the pump 26 and the consumer load 28 is interrupted by the valve 27 illustrated here, the load pressure on the load pressure side 8 will dissipate via leakage duct 24 in the cylindrical passage 41, and the sump connection channel 17. The pump pressure will then force the balance piston 2 toward the spring 10 and thus form a connection through the bore 40 between the pump pressure channel 3 and the sump discharge 7 and around the control edge 6. The pump thus delivers only to the sump, i.e., idles. It is desirable for the power effort necessary for such idling to be as low as possible. For this reason, it is desirable to have as low a residual pump pressure as possible in the idling mode, which can be attained only if the spring tension 10 is as low as possible. This is not desirable in many cases for control technology reasons for operation of the consumer load. For this reason, the embodiment according to FIG. 1 has the retaining element 11, which biases the spring 10 upon operation of the consumer load.

The retaining element 11 is movable toward the left from the shoulder 12. It should be noted that the retaining element has oil discharge openings 39 on its rear side, i.e., toward the shoulder 12, and does not have a sealing effect with respect to the shoulder 12. The retaining element is also engaged by one end of a differential piston 13, which is slidably mounted in a cylindrical cavity 42 in the housing, and which is axially aligned with the bore 40 and communicates with the passage 41. The differential piston 13 consists of the small piston end 15 which extends through the passage 41 and engages the retaining element 11, and a large piston end or head 14 which is disposed in the cavity 42. The head 14 is connected on the load pressure side 16 with the consumer pressure channel 9 via the passage 43. The annular surface side 18 of the differential piston is connected with the sump discharge 7 through the sump discharge channel 17. The pressure in the portion of the bore 40 on the load pressure side 8 is applied to the small piston end 15. This means that the differential piston 13 is displaced toward the left against the retaining element 11 by the consumer pressure, the spring 10 being compressed thereby. The differential piston thus travels a defined reciprocation path 21. The reciprocation path can be adjusted through the wedge-shaped stop 22 by means of an adjusting screw 23. The force exerted by the spring 10 is also adjusted thereby.

As soon as the consumer load 28 is disconnected from the pump by means of valve 27, pressure is relieved on the load pressure side 8 and the load pressure side 16 of the differential piston. Due to the design of the opening 39 and leakage duct 24, this drop in load pressure and thus also the release of tension of the spring 10 occur with a defined delay, so that load pressure fluctuations have no effect. It will also be noted that the passage 43 from the consumer channel 9 into the cavity 42 is parallel to the passage through the restriction 19 and leading to the load pressure side 8, and is free of any restriction. Thus the throttle or restriction 19 is more narrow than any restriction in the passage 43, and upon connection of a load to the system, pressure is first applied to the load pressure side 16 of the differential piston, and thus the spring 10 is first moved into its operating position before the pressure in the pressure side 8 has increased to the load pressure. The effect on the differential piston 13 and its movement is accordingly that the spring 10 receives its optimum tension when the consumer load 28 is in operation, and its tension is relieved when the pump 26 is in an idling mode, to the extent that an acceptable residual pump pressure may be employed.

The embodiment illustrated in FIG. 2 also has a so-called "pressure difference balance" with cylinder housing 1, balance piston 2, pump pressure inlet channel 3, pump pressure side 5, control edge 6, sump discharge channel 7, load pressure side 8, consumer or load pressure channel 9, and spring 10. This pressure difference balance can also be incorporated in a hydraulic circuit as illustrated with sump 25, pump 26, valve 27 and consumer load 28. When the consumer load 28 is in operation, the balance piston 2 has the same functions as discussed above with respect to FIG. 1. The difference from FIG. 1 is that the connection between the pump pressure channel 3 and the pump pressure side 5 of the pressure difference balance is by way of the overflow channel 29 and the valve 30.

A retaining piston 31 is provided in a retaining cylindrical cavity 32 to compensate for the tension of spring 10 in the idling mode. The retaining piston 31 has a head 44 slideably disposed in the cavity 32, and an extension 33, which contacts the balance piston 2 on the pump pressure side 5. The end surface 34 on the working side of the retaining piston is substantially greater in area than the end surface of the balance piston on the pump pressure side 5. In the embodiment shown, the retaining cavity 32 and the end portion of the bore 40 adjacent the pump pressure side 5 of the balance piston 2 coaxially merge. It is also possible, however, that both are sealed against each other at the extension 33. The valve 30 is provided for switching the functions of the retaining piston 31 and the balance piston 2. Valve 30 is a two-position valve. In the rest position of the valve 30, the pump pressure channel 3 is connected via channel 37 and channel 38 with the working end surface 34 of the retaining piston 31, and the end portion of the bore 40 adjacent the pump pressure side 5 communicates via channel 29 and channel 36 with the sump discharge channel 7. Thus if there is no consumer pressure, that is, the valve 27 is in the rest position, the pump pressure is applied to the working end surface 34 of the retaining piston 31. Due to the larger piston surface of the retaining piston 31, the spring 10 is thus biased by an increased force, so that the balance piston 2 continues to travel to the right in the idling mode and thus releases a greater flow at the control edge 6 between the pump 26 and the sump 25. Thus less pump pressure is required during idling.

If a consumer pressure builds up on the consumer pressure side 8 of the pressure difference balance, that is, in the operating positions of the valve 27, this consumer pressure is applied through channel 35 to actuate the valve 30. The valve 30 then connects the pump pressure channel 3 via channel 37 and channel 29 with the pump pressure side 5 of the balance piston 2, and also connects the working end surface 34 of the retaining piston 31 via channels 38 and 36 with the sump discharge 7. Thus upon with application of load pressure on the pressure difference balance, the retaining piston 31 travels to the left and is put out of action. The usual function of the balance piston 2 then comes into play with equilibrium between the force exerted by the pump pressure on the pump pressure side 5 and the tension of spring 10 and the force exerted on the consumer pressure side 8 by the consumer pressure. This controls the pump pressure at the control edge 6 such that delivery of the pump 26 to the consumer load 28 is constant. This embodiment also provides the possibility of optimum tension in the spring 10 when a consumer load is operated, and acting against this spring tension to the extent desired for reducing the residual pump pressure in the idling mode.

In the drawings and specification, there has been set forth a preferred embodiment of the invention and although specific terms are employed, they are used in a generic and descriptive sense only and not for purposes of limitation.

That which is claimed is:

1. A flow control apparatus adapted to provide load independent flow regulation in a hydraulic power system or the like, and characterized by the ability to minimize the idling power consumption of the pump when the load is removed from the system, and comprising, a housing having a cylindrical bore therein, said bore having closed opposite ends so as to define first and second opposite end portions;

a pump inlet channel, a sump outlet channel, and a consumer channel, all communicating with said bore in said housing, a balance piston slidably disposed in said bore and movable between a bypass or idling postion wherein fluid flows from said pump inlet channel through said bore to said sump outlet channel, and an operating postion wherein such flow is precluded, means for conducting fluid from said pump inlet channel into said first end portion of said bore and so as to act against a first end of said piston to urge the piston in a direction toward its bypass position, means for urging the piston in the opposite direction and toward its operating postion, and including (a) passageway means for conducting fluid from the consumer channel into said second end portion of the bore and so as to act against the second end surface of the piston, and (b) a spring disposed in said second end portion of said bore and having one end thereof disposed in contact with said second end of said piston, the improvement therein comprising a retaining piston slidably mounted in a cavity disposed in said housing in communication with said first end portion of said bore, said cavity having a transverse dimension substantially greater than that of said bore and said retaining piston having an enlarged head closely received within said cavity and a body portion extending axially toward said first end of said balance piston, with said head defining a forward bore portion between said head and said first end of said balance piston, and a rearward bore portion on the opposite side of said head, control means for alternatively (a) conducting fluid from said pump inlet channel to said forward bore portion while opening said rearward bore portion to said sump outlet channel, to thereby withdraw said retaining piston from contact with said balance piston, or (b) conducting fluid from said pump inlet channel to said rearward bore portion while opening said forward bore portion to said sump outlet channel, to thereby bias said retaining piston into contact with said balance piston, whereby the retaining piston is adapted to amplify the force tending to move the balance piston toward the bypass position and against the spring during non-operation of a consumer load, and the amplifying force is removed during operation of the consumer load, to thereby minimize the pressure of the fluid in the pump inlet channel which is required to move the balance piston to the bypass position.

2. The flow control apparatus as defined in claim 1 wherein said control means includes valve means operatively connected to said consumer channel for operating in accordance with alternative (a) upon fluid pressure being present in the consumer channel, and operating in accordance with alternative (b) in the absence of fluid pressure in the consumer channel.

* * * * *